United States Patent [19]

Eckenrode, Jr.

[11] Patent Number: 4,487,392

[45] Date of Patent: Dec. 11, 1984

[54] RADIATOR VENT VALVE

[76] Inventor: Lewis A. Eckenrode, Jr., 284 Philadelphia Ave., Chambersburgh, Pa. 17201

[21] Appl. No.: 417,565

[22] Filed: Sep. 13, 1982

Related U.S. Application Data

[63] Continuation-in-part of Ser. No. 196,126, Oct. 10, 1980.

[51] Int. Cl.[3] ..... F16K 47/00

[52] U.S. Cl. ..... 251/121; 251/216; 251/339; 138/43

[58] Field of Search ..... 251/118, 121, 339, 216, 251/225; 138/40, 43

[56] References Cited

U.S. PATENT DOCUMENTS

| | | | |
|---|---|---|---|
| 497,298 | 5/1893 | Brameld | 137/587 |
| 586,534 | 7/1897 | Pickett | 137/533.11 |
| 694,746 | 3/1902 | Hanna | 251/215 |
| 979,489 | 12/1910 | Heeney | 251/118 |
| 1,078,584 | 11/1913 | Jones | 251/216 |
| 1,275,750 | 8/1918 | Van Vechton Riesberg | 236/65 |
| 1,410,723 | 3/1922 | Rogers | 251/215 |
| 1,502,786 | 7/1924 | Kraft | 417/480 |
| 1,656,349 | 1/1928 | Garrison | 137/533.19 |
| 1,778,612 | 10/1930 | Tweed | 235/201 |
| 1,881,538 | 11/1932 | Harrington | 137/533.19 |
| 1,905,527 | 4/1933 | Thomas et al. | 138/43 |
| 1,918,959 | 7/1933 | Culp | 138/43 |
| 2,105,971 | 1/1938 | Grigg | 137/533.19 |
| 2,265,888 | 12/1941 | Beck | 138/43 |
| 2,266,321 | 12/1941 | Holder | 251/339 |
| 2,287,075 | 6/1942 | Yonkers | 236/64 |
| 2,340,220 | 1/1944 | Hedfield | 236/64 |
| 2,438,776 | 3/1948 | Boylan | 251/339 |
| 2,460,407 | 2/1949 | Andrus | 138/43 |
| 2,524,996 | 10/1950 | Sayers | 137/534 |
| 2,633,870 | 4/1953 | Lind | 137/534 |
| 2,771,902 | 11/1956 | Winchester | 251/148 |
| 3,163,684 | 12/1964 | Gilbert | 137/533.11 |
| 3,166,666 | 1/1965 | Williams | 237/16 |
| 3,384,338 | 5/1968 | Dermody | 251/216 |
| 3,473,781 | 10/1969 | Abbott et al. | 251/216 |

FOREIGN PATENT DOCUMENTS

| | | | |
|---|---|---|---|
| 289678 | 7/1953 | Fed. Rep. of Germany | 251/118 |

*Primary Examiner*—A. Michael Chambers

*Attorney, Agent, or Firm*—Banner, Birch, McKie & Beckett

[57] ABSTRACT

A vent valve for steam radiators fired by intermittent furnaces is disclosed. The valve includes a conduit with two portions. Two blocking rods form constricted areas within the two portions to throttle air escaping from the radiator.

14 Claims, 6 Drawing Figures

FIG. 1.

RADIATOR VENT VALVE

CROSS-REFERENCE TO RELATED APPLICATION

This application is a continuation-in-part of application Ser. No. 196,126 filed Oct. 10, 1980 by the present inventor entitled "Radiator Vent Value."

TECHNICAL FIELD

The present invention relates to vent valves for use with steam radiators. The vent valve is particularly adapted for use with one-pipe steam radiator systems which are heated by an intermittently fired furnace, such as an oil gas furnace.

BACKGROUND OF THE INVENTION

It is generally recognized that steam radiators cannot efficiently transfer heat through the radiator walls if air is present in the heating medium. Numerous types of vent valves have been used with prior art steam radiators. Some of these valves rely on floating or thermally expansible elements to control venting of air. The prior art vent valves have been generally complex in construction and, hence, relatively expensive. Also, it is applicant's belief that existing vent valves have been designed specifically for use with continuously fired furnaces such as coal burning furnaces, wherein pressure within the radiators reaches two or more psig. Applicant has found that some prior art vent valves are not suitable for use with intermittently fired steam heating systems wherein lower pressures in the order of 1 psig occur; for example, air lock may develop and the radiator may fail to develop any appreciable heat, because the air lock inhibits the flow of heating medium from the furnace of the radiator.

A number of prior art vent valves are disclosed in U.S. Pat. Nos. 1,275,750; 1,778,612; 2,287,075 and 2,340,220.

SUMMARY OF THE INVENTION

The present invention is directed to a vent valve for use with heating radiators. The vent valve includes a conduit adapted to be placed in fluid communication with a radiator. The conduit has a first portion and a second portion extending transversely therefrom. An upper outlet port is located in the second portion to provide fluid communication through the second portion. A hollow interior extends through both conduit portions. A first blocking rod is located within the first portion, and has at least one opening to provide a vent passage into the hollow interior of the first portion of the conduit. The first rod and the first portion form a first constricted condensation area between the exterior of the first rod and the interior of the first portion. A second blocking rod is mounted adjacent to the upper outlet port and extends into the hollow interior of the second portion. The second rod and the second portion form a second constricted condensation area between the exterior of the second rod and the interior of the second portion.

The first portion of the conduit extends generally horizontally and the second portion extends generally vertically upwardly therefrom. The vertical second portion of the conduit has a threaded exterior and an upper edge. A cap which has a threaded surface adapted to mate with the threaded exterior of the vertical second portion is threaded down onto the vertical portion.

A screw with a slotted head serves as the first blocking rod and is confined within the hollow interior of the first portion. The screw head faces away from the junction of the first and second portions and toward the inlet of the vent valve. The slotted screw head provides a vent passage into the hollow interior of the conduit.

In a first embodiment, the second blocking rod is a bolt. The bolt is threaded into a nut, which is supported on the upper edge of the vertical portion within and beneath the cap. The nut is secured thereto by contact with the upper interior surface of the cap. The bolt shank extends through the nut into the hollow interior of the vertical portion of the conduit. A washer is located between the cap and the bolt head and the bolt passes through the washer. The body of the bolt has at least one tapered side to provide a vent passage to the ambient from the hollow interior of the conduit.

In a second embodiment, the second blocking rod is a screw with a slotted screw head. The screw is supported on a washer which, in turn, in supported on the upper edge of the second portion. Both the second screw and the washer are located within and beneath the cap. The second screw shank extends through the washer into the hollow interior of the second portion. A gap between the center of the washer and the screw head together with the slot in the screw head provide a vent passage to the ambient from the hollow interior of the conduit.

In a third embodiment, the second blocking rod is a screw with a slotted head, which is supported on the upper edge of the second portion within and beneath the cap. The shank of the second screw extends into the hollow interior of the second conduit. A washer is supported on the second screw and the upper edge of the second portion within and beneath the cap. The washer has at least one opening formed therethrough so that the washer and the slotted head provide a vent passage to the ambient from the hollow interior of the conduit.

The vent valve of the present invention provides adequate venting and control of steam radiators used in conjunction with intermitently heated furnaces, such as gas or oil fire furnaces. The vent valve of the present invention utilizes stock parts and, hence, is a simple, inexpensive, and reliable construction. The first and second embodiments can be adjusted to have the radiator run hot or cold, while the third embodiment is preset.

Various advantages of the features of novelty which characterize the invention are pointed out with particularity in the claims annexed hereto and forming a part hereof. However, for a better understanding of the invention, its advantages and objects obtained by its use, reference should be made to the drawings which form a further part hereof, and to the accompanying descriptive matter, in which there are illustrated and described several embodiments of the invention.

DETAILED DESCRIPTION OF THE INVENTION

Figure 1:
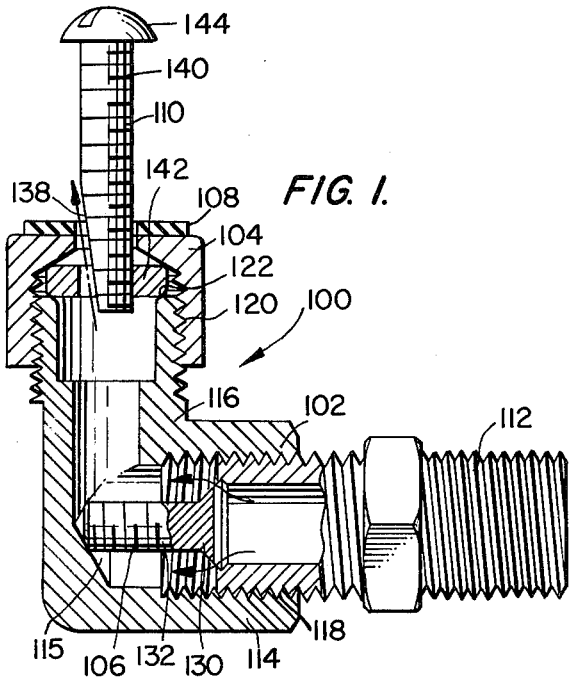
FIG. 1 is a cross-sectional view of a vent valve in accordance with the first embodiment of the invention.

Referring to the drawings in detail, wherein like numerals indicate like elements, there are shown in FIGS. 1 through 6 three embodiments of vent valves in accordance with the present invention designated generally as 100, 200, and 300.

Vent valve 100 is designed to be used with steam radiators, preferably in a one pipe steam system heated by an intermittently fired furnace, such as an oil or gas furnace. Valve 100 generally comprises conduit 102, cap 104, first blocking rod in the form of a screw 106, washer 108, second blocking rod in the form of a bolt 110 and radiator coupling 112. Vent valve 100, by means of the first and second blocking rods allows air trapped in a radiator system to escape into the atmosphere, without allowing any water in the form of steam or liquid to escape. Thus, vent valve 100 causes a radiator to operate more efficiently.

Conduit 102 has a hollow first portion 114 and a hollow second portion 116 extending perpendicularly therefrom. First portion 114 has threaded interior 118, which is adapted to receive radiator coupling 112. When coupling 112 is threaded into conduit 102 and valve 100 placed on a radiator, first portion 114 is disposed generally horizontally, and second portion 116 extends upwardly therefrom in a generally vertical direction.

Second portion 116 has threaded exterior surface 120 and upper annular edge 122. Cap 104, which has a threaded interior surface 124, is adapted to matingly receive threaded exterior surface 122. As will be discussed later, second blocking rod, i.e. bolt 110 interacts with cap 104 when treaded onto exterior surface 120 to vent into the ambient air trapped in a radiator system.

Screw 106 has a slotted head 130 and a shank 132, and is confined within first hollow portion 114 by radiator coupling 112. The bottom of shank 132 is lodged against conduit 102 at the junction point 115 of first and second portions 114 and 116, while screw head 130 faces away from junction 115, toward the inlet to vent valve 100, and is lodged against the end of coupling conduit 112. Screw head 130 need not be firmly lodged against the end of coupling conduit 112, but may be permitted a limited degree of play. Thus, screw 106 is supported in a substantially fixed position in first portion 114. A slot 134 in screw head 130 provides a vent opening or passageway from connection 112 into the hollow interior conduit 102. The area between the heads 130, shank 132 and the interior surface of conduit 112 and first portion 114 serve as a first reduction or constriction area for the condensation of water from the venting air.

Figure 2:
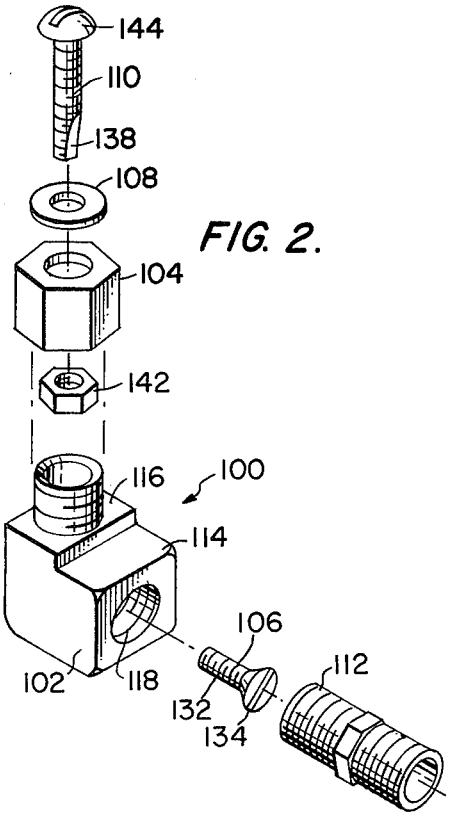
FIG. 2 is an exploded perspective view of the embodiment illustrated in FIG. 1.

In a first embodiment shown in FIGS. 1 and 2, a bolt 110 serves as the second blocking rod and has an inclined face or taper 138 cut into its shank 140 to allow variable throttling. Shank 140 matingly fits into nut 142, which rests upon annular edge 122. Nut 142 is held on annular edge 122 by cap 104. The space between shank 140, nut 142 and the interior surface of second portion 116 acts as a second reduction area, which also condenses water in the air being vented into the ambient through cap 104. Washer 108 is fitted between the top of cap 104 and below bolt head 144 to act as a final throttling area when sufficient pressure has been achieved in the radiator system. To prevent the removal of screw 110, the end of its shank 140 may be peened. While shank 140 is shown tapered only on one side and at a particular angle, the taper can be made at a different angle and along a different length of the shank. One suitable taper is along three-quarters of the length of the shank to a maximum of one-quarter of the thickness of shank 140. Also, more than one side may be tapered.

In operation, unwarmed air being driven out of a radiator system after an intermittently fired furnace is ignited enters conduit 102 through radiator connection 112. The air passes through the two slots in the first blocking rod, screw 106, and water suspended in the air is condensed by the first constricted area between screw head 134 and the hollow interior of the first portion 114. Screw 106 also acts as a safety restriction to provide a degree of throttle should cap 104 be removed. The air continues through conduit 102 into second portion 116. Passing through the second constricted area, formed between inclined face 138 and the nut 142, the water in the air is condensed further, and the air finally passes out of conduit 102 by passing between bolt 136 and washer 108. Bolt 110 can be variably threaded into nut 142 to vary the amount of throttling that occurs in the second constricted area. For example, for maximum heat, screw 110 is raised to its maximum height out of conduit 102.

Figure 3:
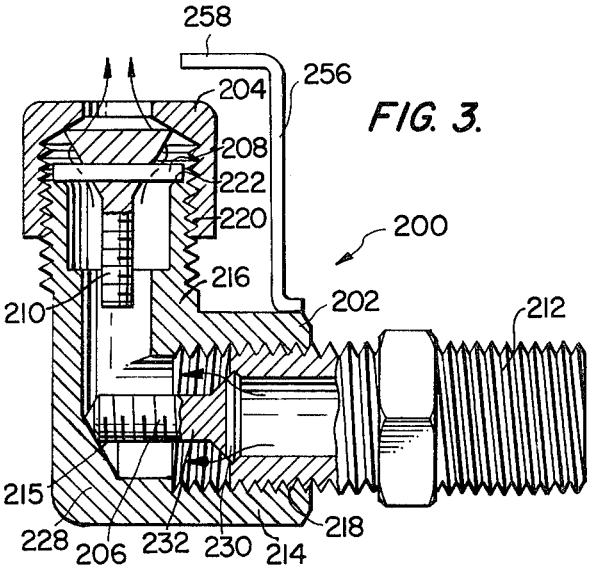
FIG. 3 is a cross-sectional view of a vent valve in accordance with a second embodiment of the invention.
Figure 4:
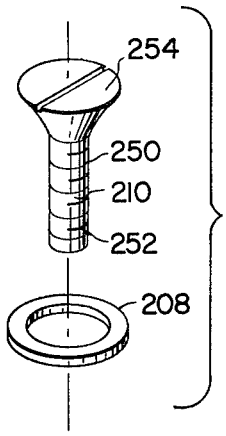
FIG. 4 is an exploded view illustrating the second blocking rod screw and washer of the second embodiment illustrated in FIG. 3.

A second embodiment of vent valve 200 is illustrated in FIGS. 3 and 4 wherein the second blocking rod is a slotted screw 210. Elements of valve 200 which correspond to elements in valve 100 will be indicated by like numbers in the 200 series. Screw 210 has a shank 252 and a slotted screw head 254. As seen in FIG. 3, screw 210 is seated in washer 208, which in turn is seated on an annular edge 222. Both screw 210 and washer 208, are within and beneath cap 204. A Z-shaped safety retaining bar 256 is attached to conduit 202, and has a restraining arm 258 which projects over cap 204. Arm 258 prevents cap 204 from being removed or accidentally coming off second portion 216, should cap 204 be threaded too loosely onto portion 216. The area between screw 210 and cap 204 forms the second constricted area. Water in the air is condensed as the air travels through conduit 202 between washer 208 and screw 210, as well as when the air vents out into the atmosphere through the slots in screw head 254. The throttling effect is varied by adjusting the position of 204 on second portion 216. By raising cap 204, washer 208 and screw 215 are free to rise higher under the influence of the venting air pressure, and the radiator will operate at a higher temperature. Air vents through the gap between the central opening in washer 208 and the slanted surface of head 254, and through the slot in head 254.

Figure 5:
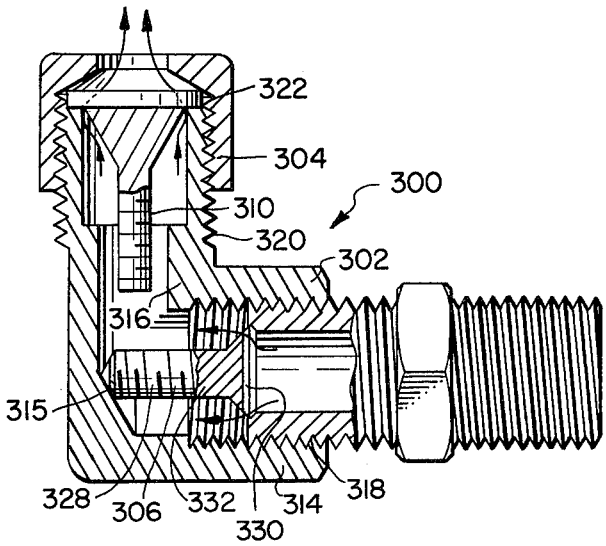
FIG. 5 is a cross-sectional view of a vent value in accordance with a third embodiment of the invention.
Figure 6:
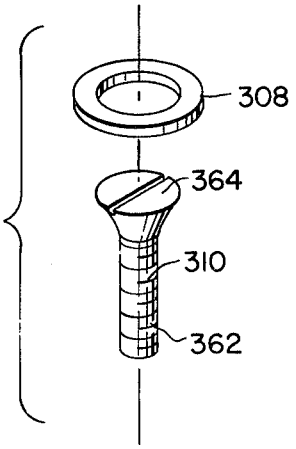
FIG. 6 is an exploded perspective view showing the second blocking rod screw and washer of the embodiment illustrated in FIG. 5.

FIGS. 5 and 6 show a third embodiment of vent valve 300 in which the second blocking rod configuration of the second embodiment is reversed. Elements of valve 300 which correspond to elements in valve 200 will be indicated by like numbers in the 300 series. Slotted screw 310 having a shank 362, and slotted screw head 364 is seated upon annular edge 322. Washer 308 is seated upon screw head 364 and held in place there by cap 304, which is permanently mounted on conduit 302. A second constricted region is formed between screw 310 and the hollow interior of second portion 316. Water in the air travelling through conduit 102 is condensed in the second constricted area. The permanent configuration of this embodiment throttles air after a certain minimum pressure is attained, eliminating the need for the user to adjust the second blocking rod. Air vents by passing through the slot in head 364, beneath washer 308 and through the central opening in washer 308.

Numerous characteristics and advantages of the invention have been set forth in the forgoing discription, together with details of the structure and function of the invention and the novel features thereof are pointed out in the appended claims. The disclosure, however, is illustrative only, and changes may be made in detail, especially in matters of shape, size and arrangement of parts, within the principle of the invention, to the full extent indicated by the broad general meaning of the terms of which the appended claims are expressed.

I claim:

1. A vent valve for use with a radiator comprising:

a conduit adapted to be placed in fluid communication with a radiator, said conduit having a first portion, a second portion extending transversely therefrom, an upper outlet port in fluid communication with said second portion, and a hollow interior extending through said portions of said conduit;

a first blocking rod supported within said first portion, said first blocking rod having at least one opening to provide a vent passage into said hollow interior of said conduit, first means for condensing water from the air venting from the radiator comprising said first rod and said first portion forming a first constricted area between the exterior of said first rod and the interior surface of said first portion; and a second blocking rod mounted adjacent to said upper outlet port and extending into the hollow interior of said second portion, second means for condensing water from the air venting from the radiator comprising said second rod and said second portion forming a second constructed area between the exterior of said second rod and the interior surface of said second portion.

2. A vent valve in accordance with claim 1 wherein said first blocking rod is supported in a substantially fixed position in said first portion of said conduit.

3. A vent valve in accordance with claim 2 wherein said first blocking rod is a screw having a head and said at least one opening is defined by a slot in the head of said screw.

4. A vent valve in accordance with claim 3 wherein said first portion of said conduit had a threaded interior, and a coupling conduit having a threaded exterior is threaded into said portion to confine said screw in said first portion.

5. A vent valve in accordance with claim 1 wherein said second blocking rod is a bolt having a head and a tapered threaded shank, a nut being supported on an upper end of said second portion, the threaded shank of said bolt being adjustably coupled to threads of said nut and extending into the interior of said second portion, said second constricted area being defined between said surface of said shank, the interior surface of said conduit and the bottom and threads of said nut.

6. A vent valve in accordance with claim 5 wherein said second portion of said conduit has a threaded exterior and cap having a mating threaded interior is threaded onto said second portion to secure said nut to the upper end of said second portion.

7. A vent valve in accordance with claim 1 wherein said second blocking rod includes a screw supported on an upper edge of said second portion.

8. A vent valve in accordance with claim 7 wherein a washer is placed on the upper edge of said second portion, and said screw extends through and is supported by said washer.

9. A vent valve in accordance with claim 7 wherein said screw contacts said upper edge of said second portion to be supported directly thereby, and a washer is support on top of said screw.

10. A vent valve in accordance with claim 8 or 9 wherein said second portion of said conduit has a threaded exterior and a cap having a mating threaded interior is threaded onto said second portion to hold said screw and washer in portion.

11. A vent valve in accordance with claim 2, 3 or 4 including connector means for connecting said valve in fluid communication to the radiator such that said first portion of said conduit extends generally vertically.

12. A vent valve for use with a radiator comprising:

a conduit adapted to be placed in fluid communication with a radiator, said conduit having a first portion, a second portion extending transversely therefrom, an upper outlet port in fluid communication with said second portion, and a hollow interior extending through said portions of said conduit;

said second portion having a threaded exterior and an upper edge, a screw supported within said hollow interior of said first portion, screw having a head with at least one opening to provide a first vent passage into said hollow interior of said conduit, said first vent passage forming first means for condensing water from the air venting from the radiator;

a cap having a threaded interior surface mating with the threaded exterior of said second portion and an upper interior surface with a hole formed therethrough, said cap being threaded down onto said second portion;

a nut supported on said upper edge of said second portion of said conduit within and beneath said cap and secured thereto by contact with said upper interior surface of said cap;

a bolt having a head facing outward, located above said cap, and a threaded shank extending inward through said cap hole, said shank being threaded into a threaded hole of said nut and extending into the hollow interior of said second portion of said conduit;

a washer located between said cap and said bolt head, said bolt shank passing through said washer; and said bolt shank being tapered on at least one side to provide a second vent passage from said hollow interior of said conduit between said tapered side and the threaded hole of said nut, said second vent passage forming second means for condensing water from the air venting from the radiator.

13. A vent valve for use with a radiator comprising:

a conduit adapted to be placed in fluid communication with a radiator, said conduit having a first portion, a second portion extending transversely therefrom, an upper outlet port in fluid communication with said second portion, and a hollow interior extending through said portions of said conduit;

said second portion having a threaded exterior and an upper edge;

a first screw supported within said hollow interior of said first portion, said screw having a head with at least one opening to provide a vent passage into said hollow interior of said conduit;

a washer supported on said upper edge of said second portion of said conduit;

a second screw having a slotted head and a shank, said second screw shank extending through a hole in said washer into said hollow interior of said second conduit so that said second screw is supported by its head resting on top of said washer and a vest passage is formed between said head of said second screw and hole in said washer; and a cap having a threaded interior surface mating with the threaded exterior of said second portion and an upper interior surface with a hole formed therethrough, said cap being adjustably threaded down onto said second portion whereby the upward and downward adjustment of said cap and said second portion adjusts the degree which said washer and second screw can be moved upwardly by the pressure of the venting air;

14. A vent valve for use with a radiator comprising:

a conduit adapted to be placed in fluid communication with a radiator, said conduit having a first portion, a second portion extending transversely therefrom, an upper outlet port in fluid communication with said second portion, and a hollow interior extending through said portions of said conduit;

said second portion having a threaded exterior and an upper edge;

a first screw supported within said hollow interior of said first portion, said screw having a head with at least one opening to provide a vent passage into said hollow interior of said conduit;

a second screw having a slotted head and a shank, said shank extending into said hollow interior of said second conduit and said head of said second screw being supported on said upper edger;

a washer having an opening supported above said second screw and said upper edge within said second portion; and a cap having a threaded interior surface mating with the threaded exterior of said second portion and an upper interior surface with a hole formed therethrough, said cap being threaded down into said second portion to hold said washer and second screw in position whereby air vents through the slot in the head of said second screw and thereafter through the opening in said washer with the hole in said cap.

* * * * *

UNITED STATES PATENT AND TRADEMARK OFFICE

CERTIFICATE OF CORRECTION

PATENT NO. : 4,487,392

DATED : December 11, 1984

INVENTOR(S) : Lewis A. Eckenrode, Jr.

It is certified that error appears in the above—identified patent and that said Letters Patent is hereby corrected as shown below:

Claim 10, column 6, line 21, "portion" should be —position—;

Claim 11, column 6, line 25, after "generally" insert —horizontally and said second portion of said conduit extends generally—; and Claim 13, column 7, line 19, "vest" should be —vent—;

column 7, line 29, ";" should be —.—.

Signed and Sealed this

*Twenty-third* Day of *April 1985*

[SEAL]

*Attest:*

DONALD J. QUIGG

*Attesting Officer* *Acting Commissioner of Patents and Trademarks*